United States Patent [19]

Kingsley

[11] 4,097,138

[45] Jun. 27, 1978

[54] PHOTOCONDUCTIVE BELT INCREMENTING APPARATUS

[75] Inventor: William Kingsley, Rochester, N.Y.

[73] Assignee: Xerox Corporation, Stamford, Conn.

[21] Appl. No.: 718,247

[22] Filed: Aug. 27, 1976

[51] Int. Cl.[2] ..... G03G 15/00

[52] U.S. Cl. ..... 355/3 DR; 355/16

[58] Field of Search ..... 355/3 DR, 16; 242/55, 242/55.19 R, 55.19 A, 67.3 R

[56] References Cited

U.S. PATENT DOCUMENTS

| | | | |
|---|---|---|---|
| 3,600,086 | 8/1971 | Cates et al. | 355/16 |
| 3,826,570 | 7/1974 | Kolibas | 355/3 DR |
| 3,887,278 | 6/1975 | Kolibas | 355/16 |
| 3,974,974 | 8/1976 | Nishikawa | 355/16 |

*Primary Examiner*—A. D. Pellinen

*Attorney, Agent, or Firm*—J. J. Ralabate; C. A. Green; H. Fleischer

[57] ABSTRACT

An apparatus in which a photoconductive belt is advanced to move incremental unused portions thereof to an operative location as incremental used portions move to an inoperative location. The apparatus includes a segmented support frame having a supply station storing unused portions of the photoconductive belt and a receiving station storing used portions thereof associated with each segment.

5 Claims, 3 Drawing Figures

PHOTOCONDUCTIVE BELT INCREMENTING APPARATUS

BACKGROUND OF THE INVENTION

This invention relates generally to an electrophotographic printing machine, and more particularly concerns an apparatus for advancing incremental portions of a photoconductive belt employed therein.

In a typical electrophotographic printing machine, the photoconductive member is charged to a substantially uniform level. A light image of an original document irradiates the charged portion of the photoconductive member selectively dissipating the charge thereon. This records an electrostatic latent image of the original document on the photoconductive member. The electrostatic latent image is developed with charged particles. These particles are transferred from the latent image to a sheet of support material. Thereafter, the particles are permanently affixed to the sheet of support material forming a copy of the original document.

Generally, the photoconductive member is charged each time a copy is made. After a plurality of copies have been made, i.e., 10,000 or more copies, the photoconductive layer suffers fatigue from discharge breakdown. When the photoconductive material has fatigued, it shows a markedly lower efficiency in forming electrostatic latent images and in transferring the toner powder image to the sheet of support material. At this time, it becomes extremely difficult to produce high quality copies. Hence, the photoconductive member must be replaced. Frequently, it is difficult to change the photoconductive member. Therefore, various techniques have been developed to introduce an unused photoconductive member into the operative location in the electrophotographic printing machine. For example, U.S. Pat. No. 3,877,806 issued to Schrempp et al. in 1975, discloses a photoconductive web stored in a cartridge housing a spool thereof. The belt is incremently advanced from the spool and entrained about a pair of opposed spaced rollers to form, in combination with the cartridge, a triangular belt configuration. Another approach is described in U.S. Pat. No. 3,926,515 issued to Nagahara in 1975. This patent teaches the use of a photoconductive strip wound on a supply reel and a takeup reel. Both the supply reel and the takeup reel are disposed within a cylindrical support. The photoconductive strip is advanced, in discrete steps, so that the entire portion of the photoconductive strip entrained about the cylindrical member is removed therefrom when it is fatigued. Finally, the electrophotographic printing machine manufactured by the IBM Corporation and sold under the tradename Copier III appears to employ a photoconductive drum having two hemi-cylinders. Each hemi-cylinder includes a supply reel and a takeup reel. In this manner, a full frame of the photoconductive web is advanced periodically from the supply reel to the takeup reel.

Although the photoconductive drum structure disclosed in the prior art effectively provides a long life by virtue of the storage of a replacement section of the photoconductor therein, these mechanisms are complex and difficult to maintain.

Accordingly, it is a primary object of the present invention to improve the photoconductive belt incrementing mechanism employed in an electrophotographic printing machine.

SUMMARY OF THE INVENTION

Briefly stated, and in accordance with the features of the present invention, there is provided an apparatus for incrementing a photoconductive belt to advance unused portions thereof to an operative location as used portions advance to an inoperative location.

Pursuant to the features of the present invention, the apparatus includes a support frame comprising at least a pair of segments. A supply station storing the unused portions of the photoconductive belt is associated with each segment of the support frame. A receiving station storing the unused portions of the photoconductive belt is also associated with each segment of the support frame. Means are provided for advancing automatically incremental portions of the photoconductive belt from each of the supply stations to each of the receiving stations. As the photoconductive belt advances, one surface thereof contacts the exterior portion of the corresponding support segment. The advancing means comprises a gear connected to the receiving station. A pinion meshes with the gear. An actuating bar has one end portion thereof secured to the pinion. Means move the actuating bar to rotate the pinion. As the gear rotates, the receiving station advances incremental portions of the photoconductive belt stored in the supply station.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
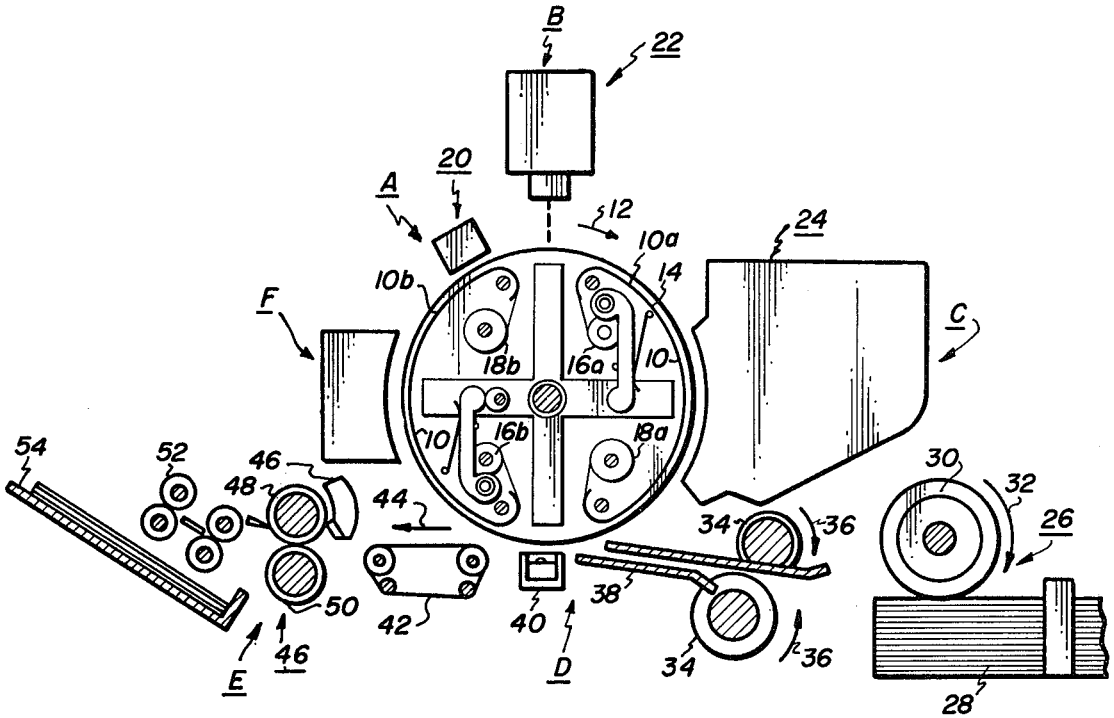
FIG. 1 depicts schematically, in elevation, an electrophotographic printing machine incorporating the features of the present invention therein.

For a general understanding of an electrophotographic printing machine incorporating the features of the present invention therein, reference is had to FIG. 1 which depicts schematically the various components thereof. Hereinafter, like reference numerals will be employed throughout to designate identical elements. Although the incrementing apparatus of the present invention is particularly well adapted for use with a photoconductive belt, it is equally well suited for use in a wide variety of devices and is not necessarily limited in its application to the particular embodiment shown herein.

Inasmuch as the practice of electrophotographic printing is well known in the art, the various processing stations for producing a copy of an original document are herein represented schematically by blocks. Each of these blocks will be briefly described hereinafter.

Figure 3:
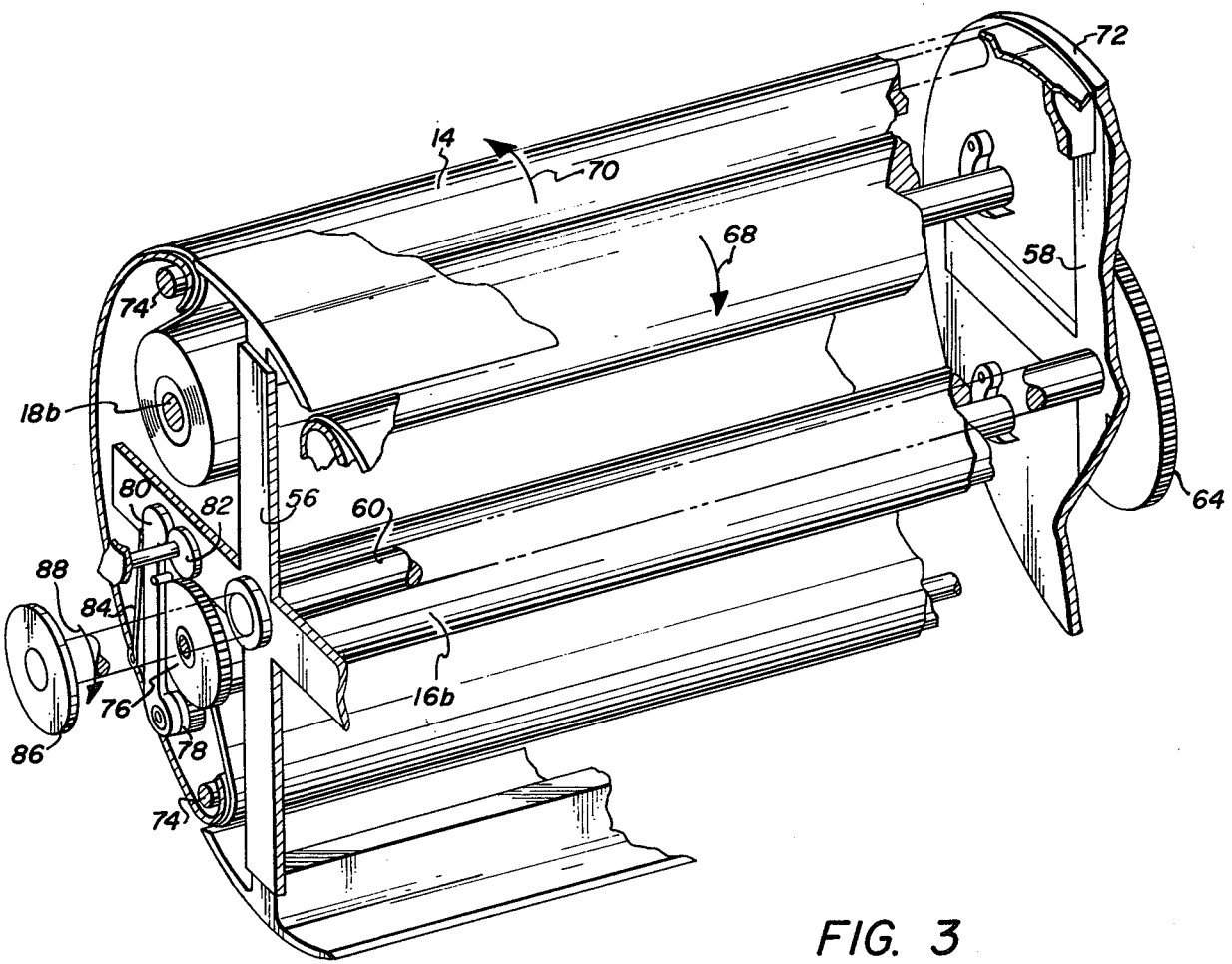
FIG. 3 is an exploded perspective view illustrating the FIG. 2 photoconductive drum.

As in all electrophotographic printing machines of the type illustrated, drum 10 is rotated about its axis in the direction of arrow 12 by a drive motor (not shown) acting through a drive gear 64 (FIG. 3). Disposed on the outer periphery of drum 10 is a photoconductive belt generally designated by the reference numeral 14. Photoconductive belt 14 preferably comprises a layer of selenium disposed on a conductive substrate such as aluminum. In lieu thereof, a suitable organic photoconductive material may be employed such as a polyvinylcarbazole. Photoconductive belt 14 is flexible with the unused portion thereof being stored in supply station, i.e., wound about supply spools 16*a* and 16*b*. The used portion thereof is stored in receiving station, i.e., wound about takeup spools 18*a* and 18*b*. Drum 10 comprises two hemi-cylinders (half cylinders) secured to one another to form a cylindrical member. Supply spools 16*a* and 16*b* and takeup spools 18*a* and 18*b* are located in the interior of the cylindrical drum chamber and associated with the corresponding hemi-cylinders or segments. Thus, segment 10*a* has supply spool 16*a* and takeup spool 18*a* mounted therein, while segment 10*b* has supply spool 16*b* and takeup spool 18*b* mounted therein.

Initially, a portion of photoconductive belt 14 rotates through charging station A. Charging station A employs a corona generating device, indicated generally by the reference numeral 20, to sensitize the surface of photoconductive belt 14. Corona generating device 20 is positioned closely adjacent to photoconductive belt 14. When energized, corona generating device 20 charges photoconductive belt 14 to a relatively high substantially uniform potential. For example, corona generating device 20 may be of the type described in U.S. Pat. No. 2,836,725 issued to Vyverberg in 1958.

Thereafter, drum 10 rotates the charged portion of photoconductive belt 14 to exposure station B. Exposure station B includes an exposure mechanism 22 having a transparent platen, such as a glass plate or the like, for supporting an original document thereon. Lamps illuminate the original document. Scanning of the original document may be achieved by oscillating a mirror in a timed relationship with the movement of drum 10. This mirror is positioned beneath the platen and adapted to reflect the light image of the original document through a lens onto a mirror which, in turn, reflects the light image through an apertured slit onto the charged portion of photoconductive belt 14. Irradiating the charged portion of photoconductive belt 14 records an electrostatic latent image thereon corresponding to the original document.

Drum 10 next rotates the electrostatic latent image recorded on photoconductive belt 14 to development station C. Development station C includes a developer unit 24 having a housing containing a supply of developer mix therein. The developer mix comprises carrier granules with toner particles adhering triboelectrically thereto. Preferably, the carrier granules are formed from a magnetic material with the toner particles being formed from a heat settable plastic. Developer unit 24 is preferably a magnetic brush development system. In such a system, the developer mix is brought through a directional flux field to form a brush thereof. The electrostatic latent image recorded on photoconductive belt 14 is developed by bringing the brush of developer mix into contact therewith. In this manner, toner particles are attracted electrostatically to the latent image to form a toner powder image on photoconductive belt 14.

With continued reference to FIG. 1, a sheet of support material is advanced by sheet feeding apparatus 26 to transfer station D. Sheet feeding apparatus 26 includes a feed roll 30 contacting the uppermost surface of the stack of sheets of support material 28. Feed roll 30 rotates in the direction of arrow 32 to advance the uppermost sheet from stack 28. Registration rollers 34, rotating in the direction of arrow 36, align and forward the advancing sheet of support material into chute 38. Chute 38 directs the advancing sheet of support material into contact with photoconductive belt 14 in a timed sequence so that the toner powder image developed thereon contacts the advancing sheet of support material at transfer station D.

At transfer station D, corona generating device 40 applies a spray of ions to the backside of the sheet of support material. This attracts the toner powder image from photoconductive belt 14 to the sheet of support material.

After transferring the toner powder image to the sheet of support material, conveyor 42 advances the sheet of support material in the direction of arrow 44 to fusing station E. Fusing station E includes a fusing apparatus 46 comprising a pair of opposed rollers 48 and 50. Fuser roller 48 is heated while backup roller 50 remains unheated. The sheet of support material passes between rollers 48 and 50 with the toner powder image thereon contacting heated fuser roller 48. In this manner, the toner powder image is permanently fused to the sheet of support material. After the fusing process, rollers 52 advance the sheet of support material to catch tray 54 for subsequent removal therefrom by the machine operator.

Frequently, after the sheet of support material is separated from photoconductive belt 14, some residual toner particles remain adhering thereto. These residual toner particles are removed from photoconductive belt 14 at cleaning station F. Initially, the toner particles are brought under the influence of a corona generating device adapted to neutralize the remaining electrostatic charge on photoconductive belt 14 and that of the toner particles. The neutralized toner particles are cleaned from photoconductive belt 14 by a rotatably mounted fibrous brush in contact therewith. Subsequent to cleaning, a discharge lamp floods photoconductive belt 14 with light to dissipate any residual electrostatic charge remaining thereon prior to the charging thereof for the next successive copying cycle.

Figure 2:
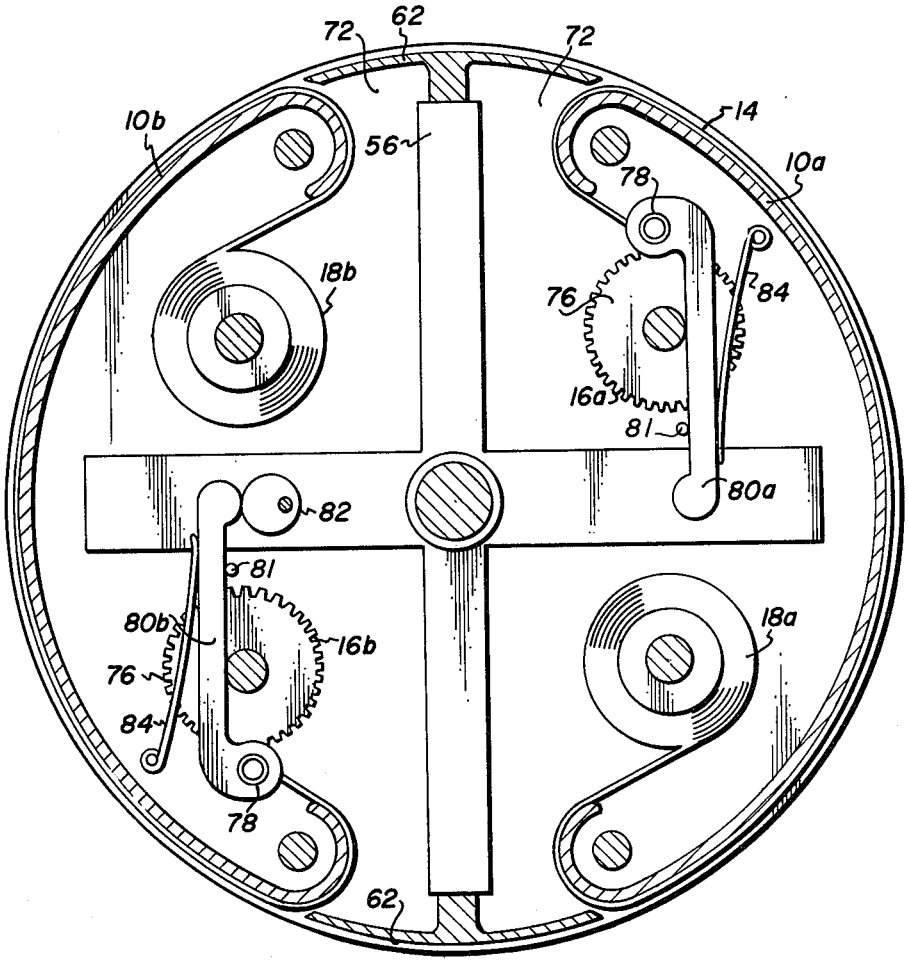
FIG. 2 shows an elevational view of the photoconductive drum employed in the FIG. 1 printing machine.

It is believed that the foregoing description is sufficient for purposes of the present application to illustrate the general operation of an electrophotographic printing machine incorporating the features of the present invention therein. Referring now to the specific subject matter of the present invention, FIGS. 2 and 3 depict the incrementing apparatus for advancing photoconductive belt 14. Photoconductive belt 14 advances a pre-selected length for each revolution of drum 10 in the direction of arrow 12.

As shown in FIGS. 2 and 3, a pair of mutually othogonal bars 56 support hemi-cylinders 10*a* and 10*b* of drum 10. Shaft 60 connects one set of bars 56 to the other set thereof in an opposed spaced relationship. Shaft 60 extends along the longitudinal axis of drum 10. Arcuate seals 62 are located along a diameter of drum 10 at opposed circumferential surfaces thereof and extend lengthwise between opposed bars 56. Seals 62 are connected to bars 56 by suitable fasteners. Bars 56 connect hemi-cylinders 10*a* and 10*b* to one another with seals 62 being interposed therebetween. The drive motor is coupled to a gear (not shown) which, in turn, meshes with gear 64 to rotate shaft 60. In this manner, drum 10 rotates at a substantially constant angular velocity through the various processing stations in the printing machine.

Supply spool 18*b* is disposed in the chamber defined by hemi-cylinder 10*b*. Supply spool 18*b* has the unused portion of photoconductive belt 14 wound thereabout. As supply spool 18*b* rotates in the direction of arrow 68, photoconductive belt 14 advances in the direction of arrow 70 and is entrained about the outer circumferential surface of hemi-cylinder 10*b*. Photoconductive belt 14 has the used portion thereof wound about takeup spool 16*b* as it advances in the direction of arrow 70. End bells 72 are secured to hemi-cylinders 10*a* and 10*b* at opposed ends thereof by tie rods 74. Gears 76 are connected to takeup spools 16*a* and 16*b*. As gear 76 rotates in the direction of arrow 68, takeup spools 16*a* and 16*b* rotate in the same direction advancing photoconductive belt 14 from the respective supply spools 18*a* and 18*b* in the direction of arrow 70. Pinion gears 78 mesh with gears 76. Thus, rotation of pinion gears 78 rotates gears 76 which, in turn, rotate takeup spool 16*a* and 16*b*, respectively. The mechanism for advancing photoconductive belt 14 about hemi-cylinder 10*a* is substantially identical to the mechanism for advancing photoconductive belt 14 about hemi-cylinder 10*b*. Hence, only one such mechanism will be discussed, in detail, hereinafter. By way of example, the mechanism for advancing photoconductive belt 14 about hemi-cylinder 10*b* will be described.

With continued reference to FIGS. 2 and 3, normally leaf spring 84 resiliently urges bar 80*b* into engagement with stop pin 81. As drum 10 rotates during the copying cycle, cam 82, mounted stationarily on the machine frame engages an end portion of bar 80*b*. Cam 82 pivots bar 80*b* away from stop pin 81 rotating pinion 78. This deflects spring 84 so that bar 80*b* returns to its normal position contacting stop pin 81 after cam 82 is spaced therefrom. However, a one way clutch couples pinion 78 to bar 80*b* insuring that pinion 78 remains in its rotated position rather than returning to its initial position with bar 80*b*. Rotation of pinion 78 rotates gear 76, which rotates takeup spool 16*b*. In this manner, photoconductive belt 14 is advanced incrementally, periodically, i.e., once per copy cycle. However, one skilled in the art will appreciate that cam 82 may be mounted on end bell 72 and driven intermittently to rotate bar 80*b*. This would also advance photoconductive belt 14 incrementally at intermittent intervals.

By way of example, if photoconductive belt 14 has a life of 10,000 images and the diameter of drum 10 is 8 inches, photoconductive belt 14 would advance 0.001 inches at each copy cycle.

A manual override arrangement is operator actuatable and connected to takeup spools 16*a* and 16*b*. As shown in FIG. 3, knob 86 is coupled to takeup spools 16*b*. Rotation of knob 86, in the direction of arrow 88, advances photoconductive belt 14 from supply spool 18*b* independent of the automatic incrementing mechanism. This enables the machine operator to remove a damaged or unsatisfactory portion of the photoconductive belt rather than waiting for the incrementing device to advance that portion therefrom.

In recapitulation, it is apparent that pursuant to the features of the present invention, as heretofore described, the incrementing apparatus incrementally advances the photoconductive belt from an operative location to an inoperative location. This enables successive unused portions of the photoconductive belt to be disposed in the operative location. The foregoing is achieved by employing a drum composed of a pair of hemi-cylinders each of which has a corresponding supply station housing an unused portion of the photoconductive belt and a receiving station storing the used portion of the photoconductive belt. The photoconductive belt is entrained about the exterior circumferential surface of the hemi-cylinder. When both hemi-cylinders are joined with one another, a substantially cylindrical drum is formed wherein successive portions of the photoconductive belt are incremented periodically from the interior to the exterior thereof. The incrementing device, itself, is a relatively simple and inexpensive gear and cam system. This system is easily repairable and minimizes potential damage to the photoconductive belt.

It is, therefore, evident that there has been provided, in accordance with the present invention, an apparatus for continuously incrementing a photoconductive belt. The apparatus of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for incrementing a photoconductive belt to advance unused portions thereof to an operative location as used portions advance to an inoperative location, including:

a support frame comprising at least a pair of segments;

at least a pair of supply stations having the unused portions of the photoconductive belt stored therein, each of said supply stations being associated with one of the segments of said support frame;

at least a pair of receiving stations having the used portions of the photoconductive belt stored therein, each of said receiving stations being associated with one of the segments of said support frame; and means for advancing automatically incremental portions of the photoconductive belt from each of the supply stations to each of the receiving stations with one surface of the photoconductive belt being in contact with the exterior portion of each segment of said support frame during movement thereof from said supply station to said receiving stations, said advancing means comprising a gear connected to said receiving station, a pinion meshing with the gear, an actuating bar having one end portion thereof coupled to the pinion, and a cam engaging the other end of the actuating bar to periodically pivot the actuating bar so as to rotate the pinion meshing with the gear, thereby advancing an incremental portion of the photoconductive belt from the supply station to the receiving station.

2. An apparatus for incrementing a photoconductive belt to advance unused portions thereof to an operative location as used portions advance to an inoperative location, including:

at least a pair of hemi-cylinders defining an interior chamber;

at least a pair of supply spools having the unused portions of the photoconductive belt wound thereabout, each of said supply spools being disposed in the chamber of one of said hemi-cylinders;

at least a pair of take-up spools having the used portions of the photoconductive belt wound thereabout, each of said take-up spools being disposed in the chamber of one of said hemi-cylinders;

means for advancing automatically incremental portions of the photoconductive belt from each of said supply spools to each of said take-up spools with one surface of the photoconductive belt being in contact with the exterior portion of each of said hemi-cylinders during movement thereof from said supply spools to said take-up spools, said advancing means comprising a gear connected to said take-up spool, a pinion meshing with the gear, an actuating bar having one end portion thereof coupled to the pinion, and a cam engaging the other end of the actuating bar to periodically pivot the actuating bar so as to rotate the pinion meshing with the gear, thereby advancing an incremental portion of the photoconductive belt from the supply spools to the take-up spools; and means for securing each of said hemi-cylinders to one another forming a cylindrical drum having each portion of the photoconductive belt entrained about the corresponding hemi-cylinder to form a substantially cylindrical photoconductive belt.

3. An apparatus as recited in claim 2, wherein said advancing means moves the photoconductive belt a preselected interval after a predetermined duration of time.

4. An apparatus as recited in claim 2, wherein the moving means of said advancing means includes means for periodically resiliently urging the other end of the actuating bar into engagement with the cam.

5. An apparatus as recited in claim 4, further including operator actuatable means for rotating said takeup spool to advance the photoconductive belt from said supply spool to said takeup spool.

* * * * *